United States Patent [19]

Small

[11] 4,151,244

[45] Apr. 24, 1979

[54] METHOD OF MANUFACTURING PRE-CAST CONCRETE PANELS

[76] Inventor: Edward B. Small, Cleavesty Lodge, East Keswick, near Leeds, Yorkshire, England

[21] Appl. No.: 691,249

[22] Filed: Jun. 1, 1976

Related U.S. Application Data

[63] Continuation of Ser. No. 557,769, Mar. 11, 1975, abandoned, which is a continuation-in-part of Ser. No. 387,368, Aug. 10, 1973, abandoned.

[51] Int. Cl.[2] ..... B28B 23/04

[52] U.S. Cl. ..... 264/228; 52/223 R; 52/602; 264/265; 264/DIG. 57

[58] Field of Search ..... 364/228; 52/223 R, 602; 264/265, DIG. 57

[56] References Cited

U.S. PATENT DOCUMENTS

| | | | |
|---|---|---|---|
| 664,710 | 12/1900 | Aunkst | 264/265 X |
| 3,533,203 | 10/1970 | Fischer | 52/223 R |

FOREIGN PATENT DOCUMENTS

| | | | |
|---|---|---|---|
| 185088 | 3/1956 | Austria | 52/602 |
| 1082089 | 12/1954 | France | 52/602 |

*Primary Examiner*—Thomas P. Pavelko

*Attorney, Agent, or Firm*—Wolf, Greenfield & Sacks

[57] ABSTRACT

A method of making a pre-cast concrete building panel wherein a sheet of hardboard is soaked in water, and while it is still wet, it is covered with a thin skin of concrete and there is formed a peripheral edge region of concrete to embed the hardboard edges. The subsequent drying out of the concrete and hardboard has the effect of binding together the hard-board and concrete, and pre-stressing the concrete.

1 Claim, 4 Drawing Figures

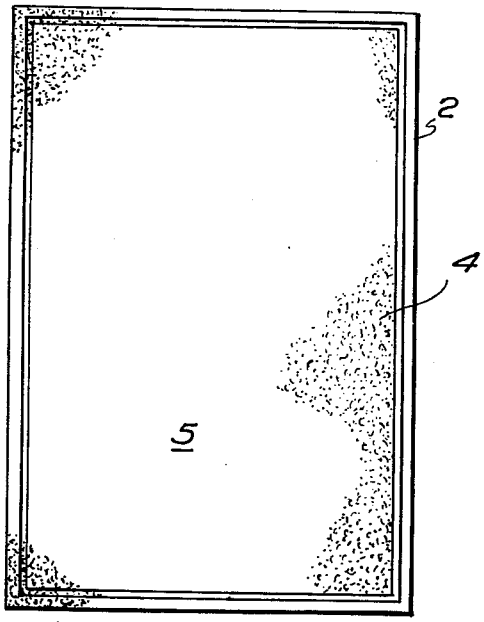
FIG. 1
FIG. 2
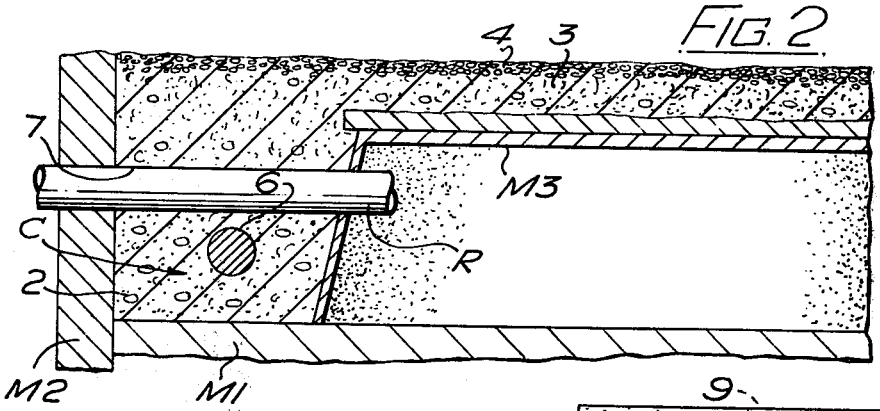
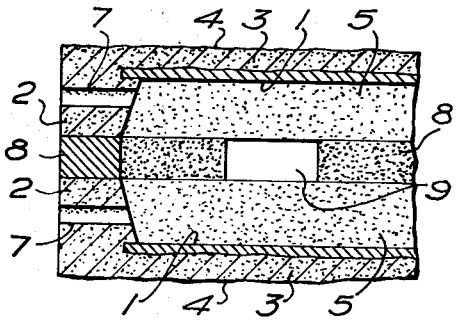
FIG 3
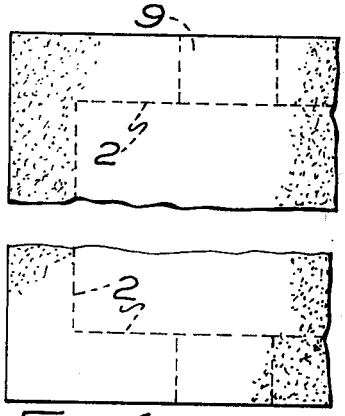
FIG. 4

METHOD OF MANUFACTURING PRE-CAST CONCRETE PANELS

FIELD OF THE INVENTION

This is a continuation of my application Ser. No. 557,269, filed Mar. 11, 1975, now abandoned, which in turn is a continuation-in-part of my co-pending application Ser. No. 387,368, filed Aug. 10, 1973, now abandoned, and the invention relates to a method of manufacturing pre-cast concrete building or panels, and relates particularly though not exclusively to a method of manufacturing pre-cast concrete building panels suitable as use as wall cladding.

BACKGROUND OF THE INVENTION

There are a number of pre-cast concrete building slabs and panels commerically available at the present time, and these known slabs and panels come in a variety of sizes and designs. For example, it is known to provide a building slab or panel with cavities in order to reduce the overall weight of the panel, and to improve its insulation properties. However, in providing such cavities there is a tendency for the panel or slab to lose some of its rigidity and strength, and if it is a smaller panel so as to be of a nature which can be carried manually and readily, then the panel thickness must be maintained at a minimum thickness, but with wire reinforcement, if the panel is to have sufficient strength.

Therefore, on the one hand, it is desirable to reduce the thickness of the slab or panel to the minimum in order to save costs, but this reduction in thickness has the effect of reducing the strength, and on the other hand, therefore, care must be taken to ensure that the panel strength is not so impaired as to make the slab or panel unusable.

It is known to include wire reinforcement in a panel to improve the strength, but this has the disadvantage of increasing the thickness of the panel to provide the necessary covering of the wire, the weight of the panel and increasing its costs.

An alternative method of reinforcing the concrete skin of a building panel, has been to utilise a backing sheet which serves as a support for the skin. This method is attractive, in that it enables the reduction of the skin fixed to a minimal. However, difficulties have been experienced in producing panels of this nature, as the skin and supporting sheet do not effectively bond together, and whilst the supporting sheet provides some resistance against impact, there is no significant support for the skin when it is subjected to bending or deflecting stress, as the skin goes into tension, and concrete as is well known is weak in tension.

BRIEF SUMMARY OF THE INVENTION

In the present invention, utilisation is made of a backing sheet of hardboard or like water absorbent material, and this backing sheet is soaked in water prior to lamination with the concrete skin. The backing material is matched to the concrete as regards shrinkage rate upon drying out of the concrete and backing sheet, so that the backing sheet and concrete skin firmly anchor together, and remain so anchored in the final panel. As the backing support shrinks and binds to the concrete, so it applies a pre-tensioning to the concrete, giving it extra strength, as the concrete will be pre-stressed, and in subsequent loading is unlikely to go into tension.

These features of the invention provide that the concrete skin can be of minimum thickness of the order of ¾ of an inch, without requiring any metal wire reinforcement. Consequently, the panel will be light in weight, and yet will have sufficient strength.

The panel is formed with a peripheral rib in which edge regions of the reinforcing sheet are embedded.

It is most desirable to use hardboard for the method of the invention.

BRIEF DESCRIPTION OF THE DRAWINGS

FIG. 1 is an elevation of a slab or panel constructed in accordance with the invention;

FIG. 2 is a fragmentary sectional view of a slab or panel constructed in accordance with the invention, showing the panel in its mould;

FIG. 3 is a fragmentary sectional side view showing how two similar panels each formed in accordance with the method of the invention may be constructed simultaneously; and FIG. 4 is a plan view of the arrangement shown in FIG. 3.

Furthermore, the section of the panel defined by the hardboard and concrete skin has surprising ductility and behaves more like a ductile metal than a concrete laminate. This effect is achieved due to the fact that the hardboard shrinks as it dries out, and during initial shrinkage of the hardboard the concrete, being still wet and having virtually no inherent strength, moves with the hardboard. After an initial period, however, the concrete sets sufficiently to resist the continuing hardboard shrinkage, and the hardboard becomes tensioned, and the concrete compressed, and hence pre-stressed. Thus, when the panel is loaded on the concrete skin, and the skin and hardboard deflect, the effect is not to tension one side of the skin as might be expected but only to release the pre-stressing, and the skin remains in compression; it is well known that concrete is very strong in compression and hence the reason why the panel has more strength than would be expected.

It may be desirable to locate wire or rod reinforcement in the cavity which is filled with concrete to reinforce the concrete placed therein, which forms a peripheral rib to the finished panel.

In a prefered case, the skin is faced by tamping aggregate thereinto whilst it is still wet.

The aggregate also adds to the strength of the panel, and contributes to the fact that the skin can be made of a minimum thickness whilst maintaining a high strength also contributing to the fact that it is not necessary for the skin to have any wire reinforcement therein. Indeed, in some examples the skin will be so thin that it would not be possible to insert any wire reinforcement.

Preferably, the rib will have bolt holes to enable securing bolts to be passed therethrough for the fixing of the slab or panel either to an adjacent slab or panel or to a structural beam or the like. Wooden or other fixing fillets may be let into the rib during casting to provide suitable nailing or screwing surfaces for example for an interior lining to be secured to the rib so as to overlie the hardboard or the like sheet.

Also according to the invention, there is provided a pre-cast panel formed in accordance with the method as aforesaid.

Referring now to the drawing in detail, and in particular to FIG. 2, the slab or panel comprises a pre-cast concrete skin which defines a major face of the panel, and on its inner face the skin is reinforced by means of a sheet of hardboard or the like material I. The slab or panel illustrated may be approximately 8'×3'4"×3" so as to be capable of being carried by one man or certainly by two men. The slab or panel has a peripheral rib 2 which is of approximately 2" square section. The thickness of the concrete skin 3 which is reinforced by the hardboard or like panel 1 may be in the region of ¾". This is a very thin skin, and because of the thickness of the skin there is no steel reinforcement therein. The reinforcement provided by the hardboard or the like sheet 1, and aggregate which is tamped into the outer surface of the skin 3 in performing the method of the invention which will be explained hereinafter.

In order to manufacture the panel shown in FIG. 1, a mould is constructed. This has a base plate M1, side pieces M2 and a recess former M3. The former M3 is smaller than the internal dimensions of side pieces M2 so that a peripheral cavity C is formed in the mould. Circular rods R are pushed through aligned holes in the former M3 and side pieces M2 to define bolt holes 7 in the finished panel as shown in FIG. 3.

Metal wire rod or bar 6 reinforcement is located in the cavity C as shown and the hardboard 1, after being thoroughly soaked in water is placed on former M3 as shown. Concrete is vibrated into the cavity C to fill same and next the concrete is skimmed over the hardboard 1, whilst it is still wet, to form the concrete skin 3. The concrete skin may be laid on the hardboard before cavity C is filled with concrete, if desired. Whilst the concrete of the skin is still wet, further surface treatment is carried out by laying the desired type of aggregate 4, by machine or by hand as desired, and in the desired layout, and subsequently tamping in the aggregate with a broad timber or the like, to the depth and distribution required. The aggregate, in addition to contributing to the strength, presents an attractive surface finish. As the hardboard and concrete dry out, so the hardboard binds to the concrete skin 3 and prestresses the same as explained hereinbefore.

In effect, it will be seen that the slab or panel is hollowed to the rear or has a rear recess 5 as shown in FIG. 3. This makes the panel light in weight, and its strength is maintained as explained herein by the provision of the hardboard or the like sheet 1.

The peripheral rib 2 is reinforced by means of the metal wire or rob 6 and is also provided with the bolt holes or slots 7 to enable securing bolts to be passed therethrough. In addition, the peripheral rib may be provided with wooden or other fixing fillets during the casing of same for the attachment of additional components or sheets to the rib as desired.

In FIGS. 3 and 4, two panels or slabs each as described in the above, are shown joined together by a peripheral concrete joint 8 provided with air gaps 9, the entity formed a hollow block which may be used for partition building or wall building. Heavier reinforcement may be incorporated in the rib to make the units more load bearing and the inner surface of the recess 5 of each panel or slab may have a coating of plaster applied thereto.

In soaking the hardboard with water, it may be desirable to introduce additives with the water in order to achieve improved bonding between the hardboard and concrete skin.

I claim:

1. A method of manufacturing a pre-cast concrete panel having a thin concrete skin overlying a reinforcing hardboard sheet whose edges are embedded in a concrete frame that is integral with the skin and extends around the periphery of the sheet, comprising the steps of (1) soaking in water a hardboard sheet of the type that is pervious to water and shrinks as it dries at a rate substantially equal to the shrinkage rate of the wet concrete skin for an appreciable period of time and to which the concrete skin adheres as it dries and which hardboard sheet continues to shrink thereafter and prestress the adherent concrete skin, (2) supporting the water soaked sheet in a mold so that the upper face of the sheet is substantially horizontal, the mold having a cavity extending around the periphery of the sheet for forming the concrete frame and the edges of the sheet extending over the cavity, (3) filling the peripherally extending cavity of the mold with concrete to embed the edge regions of the sheet and form a frame around the sheet having a thickness substantially greater than the thickness of the concrete skin, (4) convering the upper face of the sheet with a thin skin or concrete while the sheet is still wet whereby the concrete skin and hardboard sheet shrink at substantially equal rates for an appreciable period of time as they dry and the skin adheres to the hardboard sheet, and (5) removing the concrete panel with its embedded sheet from the mold after the concrete has set sufficiently to retain its shape without the assistance of the mold.

* * * * *